United States Patent [19]

Ango

[11] 4,023,542

[45] May 17, 1977

[54] LOAD RESPONSIVE VARIABLE STROKE INTERNAL COMBUSTION ENGINE

[76] Inventor: Alvino J. Ango, 1252 Elliott St., Madison Heights, Mich. 48071

[22] Filed: Feb. 27, 1976

[21] Appl. No.: 662,155

[52] U.S. Cl. ..... 123/58 R; 123/78 R; 123/43 AA

[51] Int. Cl.[2] ..... F02B 75/26

[58] Field of Search ..... 123/58 R, 58 A, 58 AA, 123/58 AB, 58 AM, 58 C, 78 R, 78 BA, 78 E, 78 F, 43 A, 43 AA

[56] References Cited

UNITED STATES PATENTS

| | | | |
|---|---|---|---|
| 793,270 | 6/1905 | Blomgren | 123/43 A |
| 1,738,512 | 12/1929 | Andrews | 123/58 AA |

*Primary Examiner*—Clarence R. Gordon
*Attorney, Agent, or Firm*—Edwin W. Uren

[57] ABSTRACT

An internal combustion four cycle engine is provided with a plurality of stationarily mounted cylinders radially arranged in equal spaced apart relationship within the inner circumference of a rotatably mounted drive drum and in parallel relationship with the axis of rotation thereof, a movable track anchorably supported by a pair of oppositely disposed raised lobes fixed to the interior webbed surface of the drum and comprised of two pairs of declining slope track quadrants serving to receive the driving thrust of each piston during its power stroke and to activate each piston during its intake, compression and exhaust strokes, and a cam ring fixed to the inner circumference of the drive drum serving to activate an intake-exhaust slide of each cylinder commensurate with the requirements of its intake, compression, power and exhaust strokes. Means resiliently coupled to a hollow exterior hub of the drum and extending internally thereof into rotatable relationship with the webbed surface serves as output means for the engine and to variably elevate the declining slope track quadrants according to the torque load that is applied to the output means, whereby the pistons of the cylinders are provided with a constant power stroke and a variable intake stroke and whereby the intake stroke attains a predetermined maximum length in the presence of a torque load applied to the output means and a predetermined minimum length in the absence of a torque load.

22 Claims, 14 Drawing Figures

LOAD RESPONSIVE VARIABLE STROKE INTERNAL COMBUSTION ENGINE

BACKGROUND OF THE INVENTION

The internal combustion engine has enjoyed a prominent role in the transportation industry, and has served as the conventional power plant for the myriads of wheeled vehicles that have been manufactured in the various countries of the world. Spear-headed in large part by the automotive industry, impetus was given the development of the internal combustion engine in the United States by the free-enterprise system, with each manufacturer vying for reliable engine performance and an advantage in the marketplace.

With the realization of acceptable engine performance and reliability, however, innovative attention in the automotive industry was redirected away from the internal combustion engine and to such promotional features as styling, roadability, handling ease, comfort and luxury. This trend away from engine innovation has persisted without significant interruption until quite recently when, due to run-away inflation and the threat of critical energy shortages, emphasis was again shifted, graphically and dramatically, to the internal combustion engine and to related innovations that might hold promise of improved fuel economy, enhanced performance, and economy in manufacture.

Notwithstanding the complacency with which the conventional internal combustion engine was regarded during the period of its slackened development, various conceptual defects in engine design have been known to those skilled in the art. Included among the defects that are now most commonly scrutinized are: (1) the manner in which the power thrust of the pistons is applied to the output shaft, (2) failure to vary the intake stroke of the pistons according to the load that is placed on the output shaft, and (3) failure to utilize the heat generating property of the pistons for pre-heating and vaporizably conditioning the fuel-air mixture prior to its passage through the intake ports of the cylinders. With reference to the first named defect above, both engine efficiency and manufacturing economy are sacrificed by applying the power thrust of the pistons to the commonly known crankshaft, such crankshaft being both exceedingly costly to manufacture and functionally inefficient by reason of the limited leverage that may be applied by the connecting rods thereagainst, as well as the power-dissipating action of the connecting rods in describing the force vector relative to the rods and the crankshaft.

With reference to the second named defect above, both fuel economy and engine performance are sacrificed by reason of the constant and unvarying nature of the intake stroke that is provided each piston regardless of the load that is applied to the output shaft, each piston being driven an equal distance by the crankshaft during its exhaust, intake and compression strokes, and the length of the crankshaft-activated intake, compression and exhaust strokes being equal to the piston-activated power stroke. In considering the unvarying nature of the intake stroke of the conventional engine, it will be apparent that fuel is wasted whenever more than the required amount of fuel-air mixture is drawn into a cylinder, and that movement of a piston by the crankshaft a greater distance than is required of an intake stroke serves to detract directly from the power that would otherwise be generated by the engine.

With reference to the third named defect above, both engine efficiency and manufacturing economy are sacrificed by failing to utilize the heat generating property of the pistons to pre-heat and to vaporize the fuel-air mixture before it is drawn into the cylinders, and by utilizing a separate and costly liquid cooling system to dissipate the piston-generated heat.

SUMMARY OF THE INVENTION

It is accordingly an object of the present invention to provide a four cycle internal combustion engine wherein manufacturing economies and enhanced engine performance are realized by eliminating the conventional crankshaft and by applying the power thrust of the pistons to the output shaft with significantly greater leverage.

It is another object of the present invention to provide an internal combustion engine wherein improved fuel economy is realized by automatically varying the length of the intake strokes of the cylinders according to the load that is placed on the output shaft, and wherein the power generated by the engine is enhanced by driving each piston a variable distance during its intake stroke, a distance that, when a minimal load is placed on the output shaft, is less than the distance of travel of the piston during its power stroke.

It is still another object of the present invention to provide an internal combustion engine wherein engine performance is enhanced and manufacturing economies are realized by utilizing the heat generating property of the pistons to pre-heat and to vaporize the fuel-air mixture before entrance into the cylinder chambers, and by eliminating the separate liquid cooling system that has generally heretofore been required for dissipating the piston generated heat.

An important aspect of the present invention is the arrangement of a plurality of cylinders in equal spaced apart radial relationship within the inner circumference of a rotatably mounted drive drum, a hollow exterior hub portion of the drum serving as an output shaft of the engine and an interior webbed surface of the drum adjacent the hub portion being provided with radially positioned first means for receiving the power thrust of the pistons during their power strokes, and for activating the pistons during their intake, compression and exhaust strokes.

Another important aspect of the present invention is the provision of second means associated with both the hollow hub portion and the interior webbed surface of the drum, said second means being effective for variably activating the first radially positioned means and to thereby maximally activate the pistons during their intake strokes when a load is applied to the output shaft, and to minimally activate the pistons during their intake strokes whenever the load on the output shaft is minimized or removed.

Still another important aspect of the present invention is the elimination of the conventional cam shaft for closeably and openably activating the intake and exhaust ports of the cylinders, and the provision of a cam ring on the inner circumference of the drive drum for activating a single slide of each cylinder effective for opening and closing both the intake port and the exhaust port thereof.

Yet another important aspect of the present invention is the provision of cylinders of double-walled construction, with a spiraling partition disposed between the walls of each cylinder for channeling and directing the fuel-air mixture around the cylinders and linearly thereof from an inlet aperture disposed along the base of the cylinder to the intake port formed in the cylinder head.

BRIEF DESCRIPTION OF THE DRAWING

These and other objects, advantages and features of the invention will become more readily apparent from the following detailed description when read in conjunction with the accompanying drawing figures, in which.

DESCRIPTION OF THE PREFERRED EMBODIMENT

The invention resides in the provision of an internal combustion engine comprised of a plurality of equally spaced apart cylinders radially disposed within the interior circumference of a drive drum and in parallel relationship with the axis of rotation thereof, the interior surface of a webbed portion of the drum being provided with a movable track having a pair of oppositely disposed high contact surfaces interconnected by means of a pair of declining slope track quadrants to a pair of oppositely disposed low contact surfaces which are movable a predetermined distance toward and away from the interior webbed surface of the drum. A hollow exterior hub portion of the drive drum is provided with a resiliently attached toothed collar forming part of means for variably positioning the low contact surfaces of the track relative to the webbed surface of the drum, according to the presence of a torque load applied to the collar, said low contact surfaces being positioned in a predetermined maximum distance from the webbed surface in the absence of a torque load on the collar, and positioned a predetermined minimum distance therefrom upon the occurrence of a torque load applied to the collar.

Figure 1:
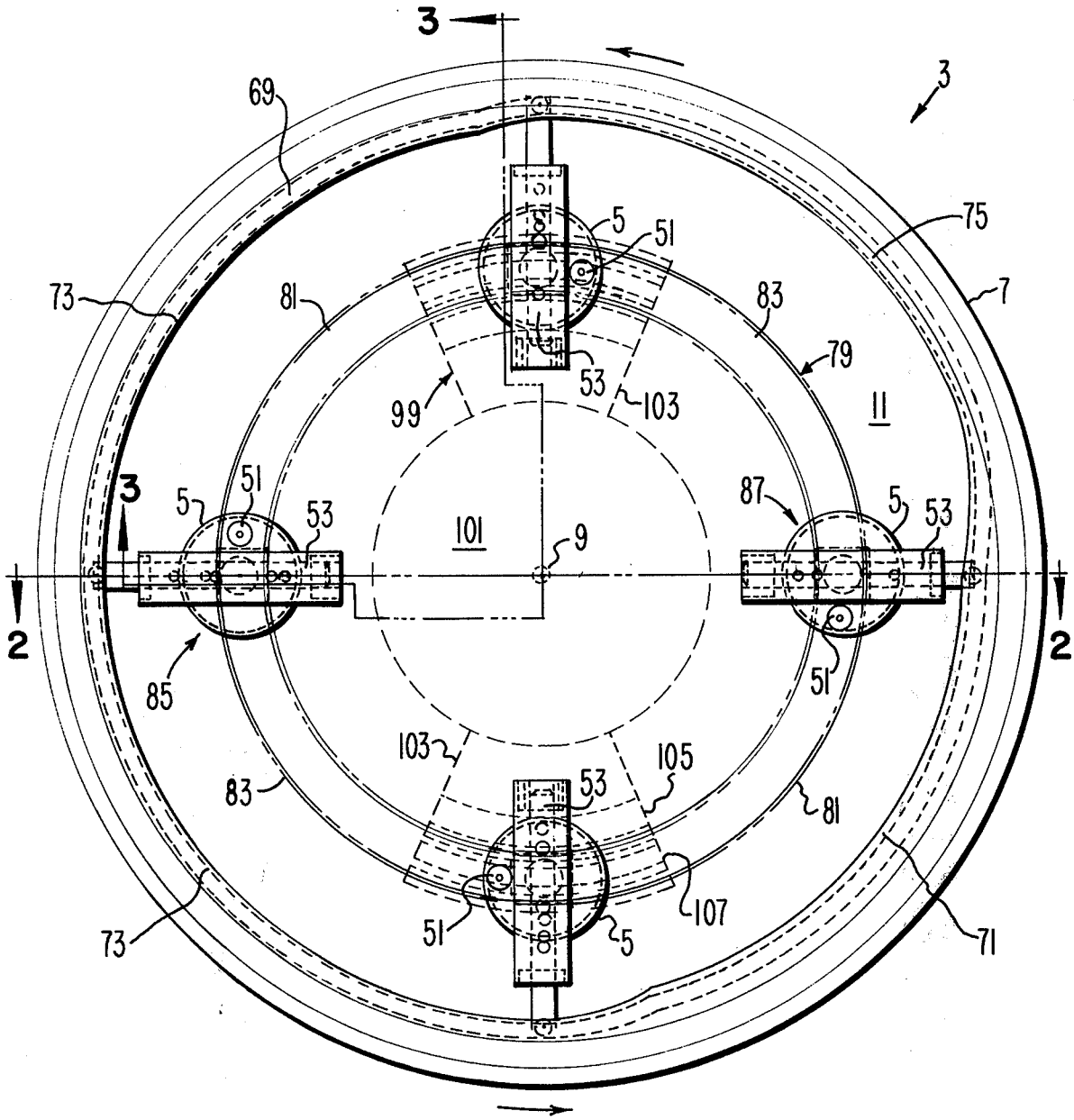
FIG. 1 is a plan view of the inventive internal combustion engine showing a plurality of equally spaced apart cylinders radially disposed of the axis of rotation of a drive drum.

As shown in FIG. 1, the inventive internal combustion engine generally designated at 3 is comprised of a plurality of vertically arranged cylinders 5 disposed in equal spaced apart relationship within the inner circumference of a drive drum 7, and in radial relationship relative to an axis of rotation 9 of the drum. The cylinders 5 are mounted within the drum 7 by means of a mounting plate 11 best shown in FIG. 2, such mounting plate being stationarily anchored by any suitable extraneous means according to the application that is to be made of the engine. It will be apparent from FIG. 2 that the drive drum 7 is rotatable about the stationary mounting plate 11, and that upper and lower bearing surfaces 13 are provided along the periphery of the plate 11 to facilitate drum rotation. A continuous peripheral ledge 15 is formed in the wall of the drum, and a continous annular seal 17 also fixed to the drum wall serves to prevent the leakage of oil from an encased drum portion 19. Forming the base of the encased portion 19 of the drum is a circular webbed surface 21 having an adjacent hollow exterior hub portion 23, the hollow central area of the hub serving to define the axis of rotation 9.

Figure 6:
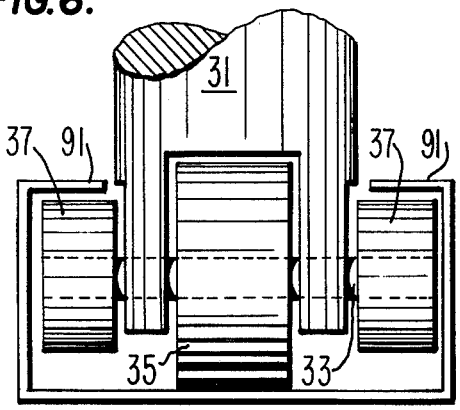
FIG. 6 is an enlarged view of the lowermost extremity of a connecting rod showing a central roller thereof in association with a pair of smaller outboard rollers.

Each of the cylinders 5 is rigidly fixed to the mounting plate 11 in communicating relationship with an associated aperture 25 thereof, each of the apertures 25 being provided with a press-fitted sleeve bearing 27. The cylinders 5 are each comprised of a ringed piston 29 to which a connecting rod 31 is rigidly connected. Each of the rods 31 is linearly reciprocable within a corresponding sleeve bearing 27 and aperture 25 of the mounting plate 11. As best illustrated in FIG. 6, each connecting rod 31 is provided with a bifurcated lowermost extremity that serves to rigidly support an elongated pin 33, such pin serving to rotatably mount a central roller 35 and a pair of outboard rollers 37.

Figure 5A:
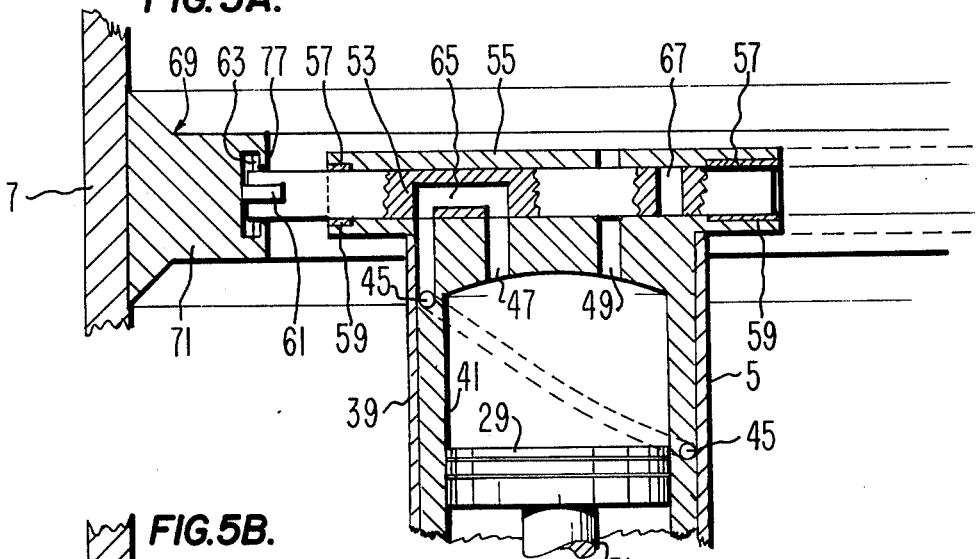
FIG. 5A is a fragmentary cross-sectional view of one of the pistons of the engine with its associated intake-exhaust slide activated by the cam ring to its intake port activating position.
Figure 5B:
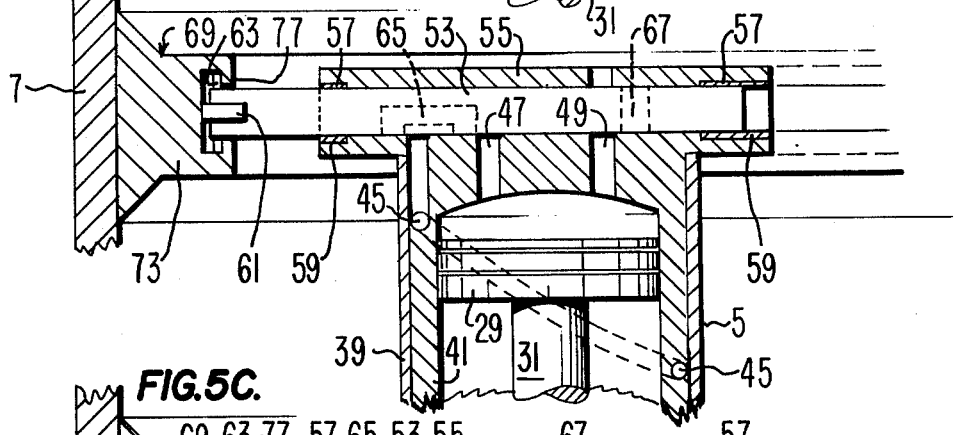
FIG. 5B is a view similar to FIG. 5A and showing the intake-exhaust slide as it would be positioned during the compression and power strokes of a cylinder.
Figure 5C:
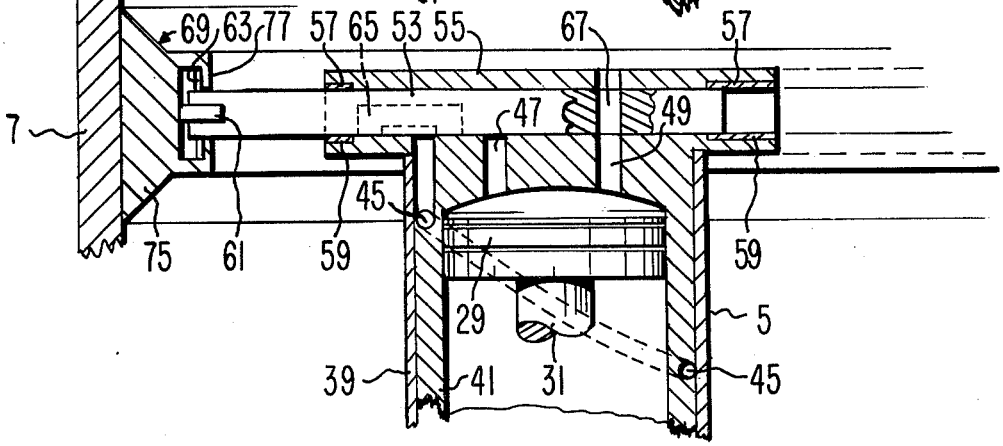
FIG. 5C is a view similar to FIGS. 5A and 5B and showing the intake-exhaust slide disposed in its exhaust port activating position.

It will be apparent from FIG. 2 that each of the cylinders 5 is provided with a pair of cylindrical walls 39 and 41, that access to the space betwen the walls is provided by means of an inlet aperture 43, and that a spiraling partition 45 is provided between the walls 39 and 41 for directing the fuel-air mixture from the inlet aperture 43 around and linearly along the inner wall 41 to a hereinafter described intake port 47. In addition to the intake port 47, the head section of each of the cylinders 5 is provided with an exhaust port 49 and a spark plug aperture 51, the latter aperture being represented in FIG. 1. Each of the cylinders 5 is additionally provided with a combination intake-exhaust slide 53 that is translatable within a raceway 55 as facilitated by a pair of upper and lower bearing surfaces 57 and 59, respectively. Each of the intake-exhaust slides 53 is also provided with a bifurcated outermost extremity and a roller 61 that is rotatably mounted by means of an elongated pin 63 that passes through apertures formed in the bifurcated extremity, the function of the roller 61 and pin 63 being described in greater detail hereinafter. Each of the slides 53 is additionally provided with a U-shaped channel 65, and a vertical channel 67, the U-shaped channel having a pair of spaced apart outlets disposed along the lower surface of the slide, and the vertical channel 67 being of linear configuration having an outlet in the top and bottom surfaces of the slide. Each of the slides 53 is activatable by a hereinafter described cam ring 69 to a fully retracted intake position as illustrated in FIG. 5A, to an intermediate compression-power position as illustrated in FIG. 5B, and to a fully extended exhaust position as illustrated in FIG. 5C. In the intake position illustrated in FIG. 5A, the vertical channel 67 is displaced from the exhaust port 49, and the U-shaped channel 65 is disposed in coupling relationship relative to the space between the cylinder walls 39, 41 and the intake port 47, to thereby condition the cylinder for an intake stroke. In the compression-power position illustrated in FIG. 5B, the vertical channel 67 and U-shaped channel 65 are both displaced from their corresponding ports 49 and 47, respectively, to thereby condition the cylinder for either a compression stroke or a power stroke. In the exhaust position illustrated in FIG. 5C, the U-shaped channel 65 is displaced from the intake port 47 and the space between the cylinder walls 39, 41, and the vertical channel 67 is located in aligned relationship with the exhaust port 49, to thereby condition the cylinder for an exhaust stroke.

The cam ring 69 referred to supra in describing FIGS. 5A, 5B and 5C, is fixed to the inner circumference of the drive drum 7 at a level thereof effective for providing cooperation with the intake-exhaust slides 53 of the various cylinders 5. The various depths of the cam ring 69 along the inner circumference of the drum is best illustrated in FIG. 1, wherein it can be seen that a maximum depth area indicated at 71 is effective for retractably activating the intake-exhaust slides 53 to their intake stroke positions, as illustrated in FIG. 5A, two continuous intermediate depth areas indicated at 73 are effective for activating the intake-exhaust slides 53 to their intermediate compression and power stroke positions, as illustrated in FIG. 5B, and a minimum depth area indicated at 75 is effective for extendably activating the intake-exhaust slides 53 to their fully extended exhaust stroke positions as illustrated in FIG. 5C. Retractable and extendable positioning of the intake-exhaust slides 53 by the varying depth areas of the cam ring 69 is accomplished by the predetermined configuration of the innermost surface of the cam ring, said configuration having a C-shaped profile defined by a pair of continuous inwardly directed lips 77. It will be apparent from FIGS. 5A, 5B and 5C that when the maximum depth area 71 of the cam ring cooperates with a given slide 53, the roller 61 of the slide will be activated inwardly by the interior webbed surface of the cam ring within its C-shaped profile. On the other hand, when a given slide 53 is activated from its fully retracted position to either its intermediate or fully extended position, repositioning of the slide is accomplished through the cooperation of the inwardly directed lips 77 and the elongated pin 63 upon which the roller 61 is mounted. The effect of drum rotation in alternately positioning the intake-channel slide 53 of a given cylinder for its intake, compression, power, and exhaust stroke is more fully described hereinafter in connection with the operation of the inventive engine.

Figure 2:
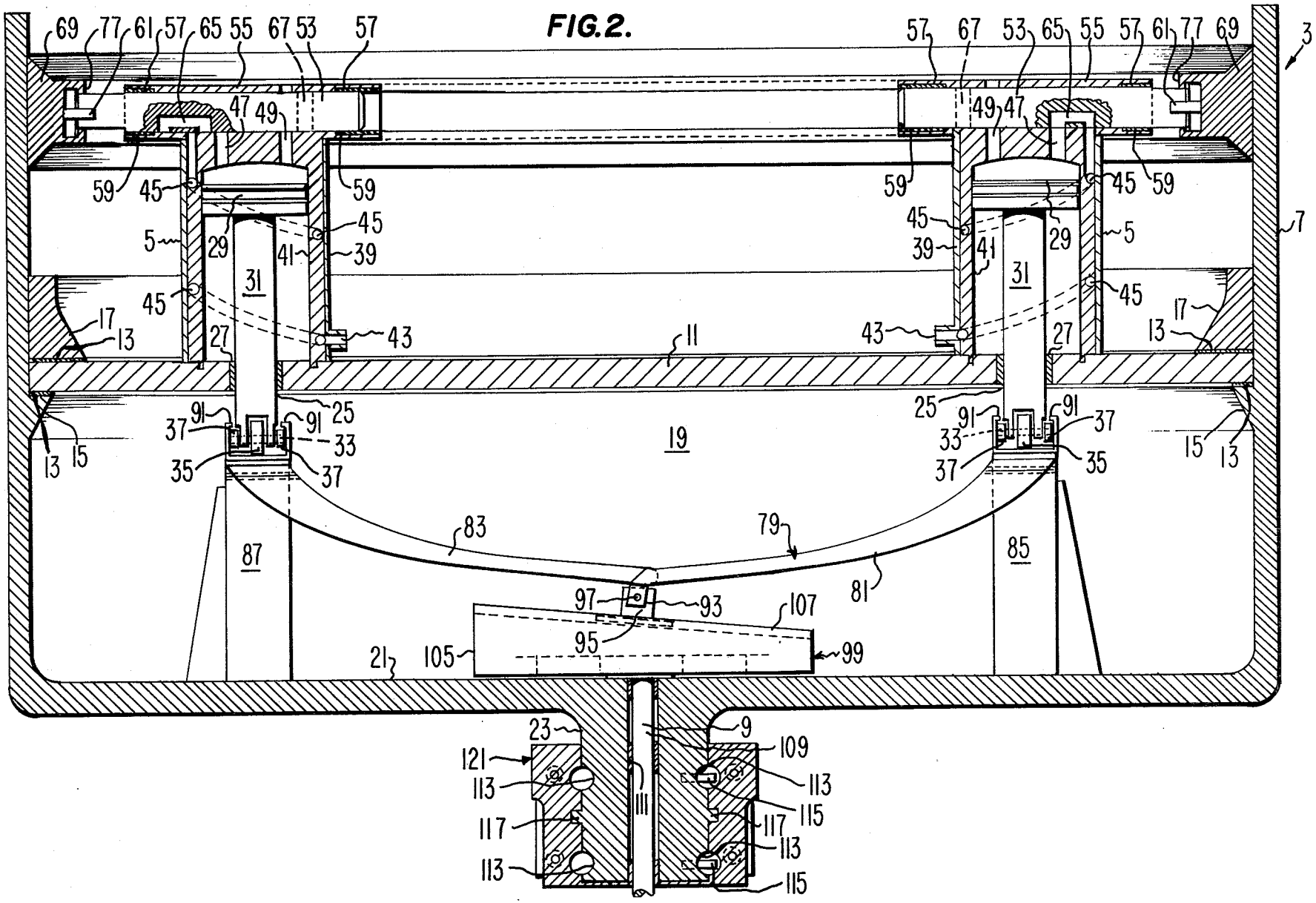
FIG. 2 is an elevational cross-sectional view of the internal combustion engine taken along the line 2—2 of FIG. 1.
Figure 4:
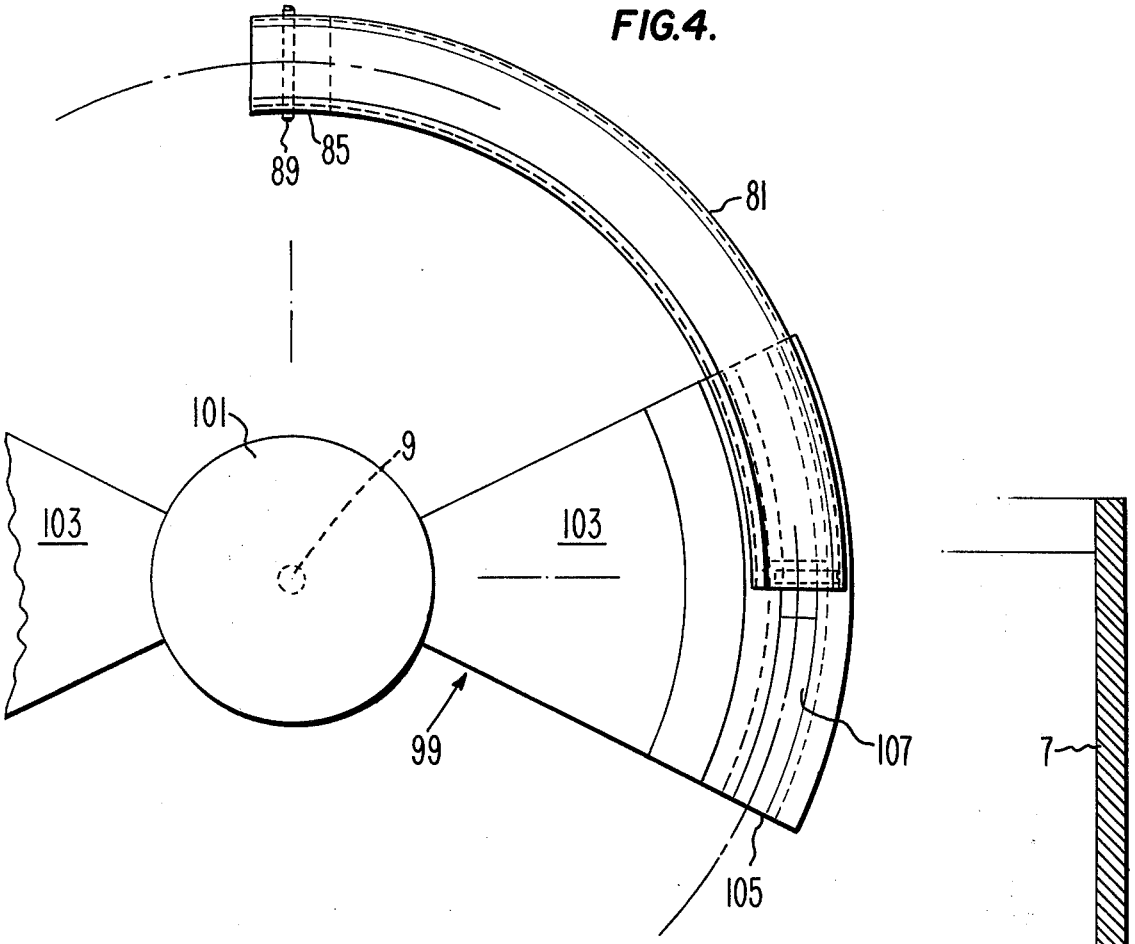
FIG. 4 is a fragmentary plan view of the interior surface of the drive drum showing one of the declining slope track quadrants in relationship with a corresponding wedged arm of a track elevating and lowering means.
Figure 3:
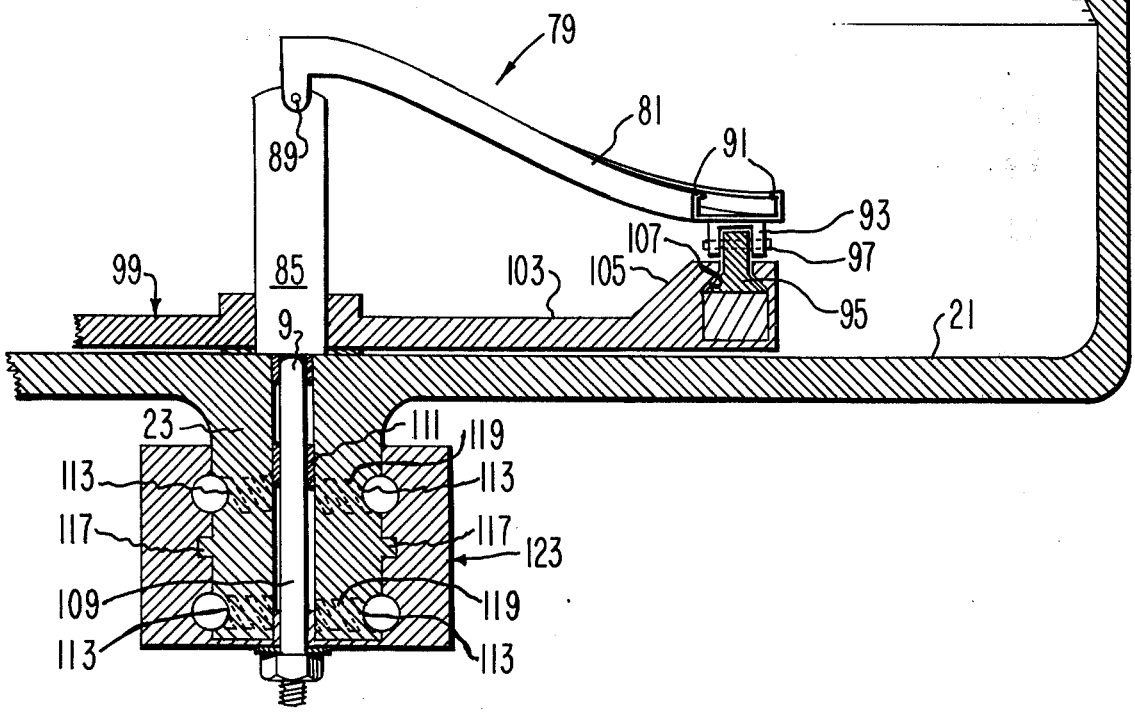
FIG. 3 is a fragmentary view of the drive drum of the engine taken along the line 3—3 of FIG. 1.
Figure 7:
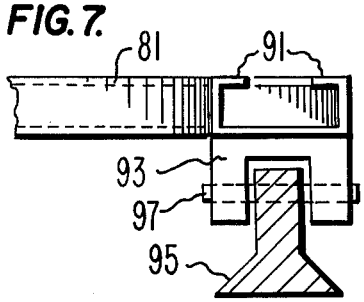
FIG. 7 is a fragmentary view showing the slidable interconnection between a pair of declining slope interacting track quadrants.
Figure 7:
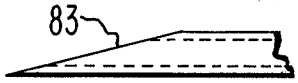

In addition to the continuous peripheral ledge 15 and the varying depth cam ring 69, the drive drum 7, within the encased portion 19 thereof, is provided with a movable drive and piston activating track generally designated at 79 in FIGS. 2, 3, 4 and 7. With reference to FIGS. 1 and 2, the movable track generally designated at 79 is comprised of two pairs of declining slope track quadrants 81 and 83 which are pivotally connected to a pair of oppositely disposed raised lobes or towers 85 and 87, the raised lobes 85 and 87 being fixed to the interior webbed surface 21 of the drive drum. The movable track 79, by means of the two pairs of declining slope track quadrants 81 and 83, serves to alternately present a pair of oppositely disposed high and low contact track surfaces to the connecting rods of the cylinders as the drum 7 rotates. The pivotal connection as between the two pairs of declining slope track quadrants and the raised lobes 85 and 87 is best illustrated in FIG. 3, wherein a pin 89 is shown to pass through apertures formed in bifurcated braces of the track quadrants and through the raised lobes. The two pairs of declining slope track quadrants 81 and 83 are channel shaped in configuration, as best illustrated in FIGS. 3 and 7, such configuration being defined by a pair of continuous inwardly directed lips 91. The declining slope track quadrants 81 pivotally connected to the raised lobes 85 and 87 are variably supported at their free ends by a clevis 93, a dovetailed slide 95, a pin 97 connecting the clevis to the slide, and by hereinafter described variable track positioning means. Inasmuch as the free ends of the pair of declining slope track quandrants 81 and 83 are variably supported by the hereinafter described variable track positioning means, it is necessary that they be interactably connected. This may be accomplished by forming the free ends of the quadrants 83 with tapered insertable walls such as shown in FIG. 7, said tapered insertable walls being receivable within the flushably formed free end extremities of the quandrants 81.

Also provided within the encased portion 19 of the drive drum 7 is a bi-petalled wedge member generally designated at 99 having a circular central section 101, a pair of connecting members 103, and a pair of wedge shaped outboard members 105. It can be seen from FIG. 2 that the wedge shaped outboard members 105 are provided with a tapering profile and that a dovetailed groove 107 linearly formed along the uppermost portion thereof conforms to the same tapering profile. As best illustrated in FIG. 3, the dovetailed slide 95 fixed to the free end extremities of each of the declining slope track quadrants 81 is slidably received within the dovetailed groove 107 of each of the wedge shaped outboard members 105. The circular central section 101 of the bi-petalled wedge member 99 is fixed to a rotatable shaft 109 that is rotatably mounted within the hollow exterior hub portion 23 of the drive drum 7, a plurality of sleeve bearings 111 being provided within the hub portion 23 to facilitate the rotation of the shaft 109. It can also be seen from FIG. 2 that a counterclockwise rotation of the wedge member 99 relative to the interior webbed surface of the drive drum 7 will result in the elevation of the free ends of the declining slope track quadrants 81 and 83, which form the low contact surfaces of the track 79, and a clockwise rotation of the wedge member 99 relative to the drum will result in the lowering of the free end extremities of the quadrants 81 and 83, to thereby lower the low contact surfaces of the track.

Figure 8:
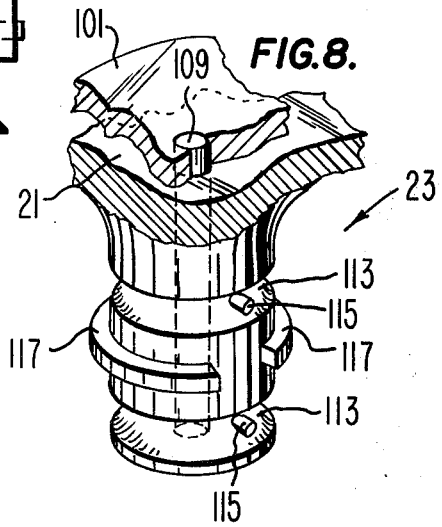
FIG. 8 is a perspective view of the exterior hub portion of the drive drum showing a pair of annular recesses for accommodating a pair of drive springs that are interactably disposed between the hub portion and a drive collar disposed therearound, and showing also a pair of limit pins disposed in the recesses and a pair of coplanarly arranged flanges disposed intermediate the recesses.
Figure 9:
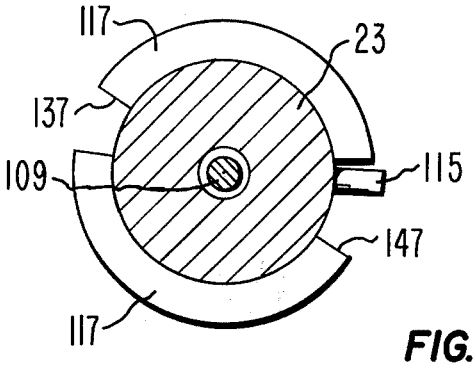
FIG. 9 is a plan view of the hub portion of the drum showing the uppermost of the limit pins as well as the arrangement of the pair of flanges.

The exterior configuration of the hub portion 23 of the drive drum 7 is best illustrated in FIGS. 8 and 9. In FIG. 8 it can be seen that the hub portion 23 is comprised of a pair of continuous annular recesses 113 having a pair of coplanarly arranged spring limit pins 115 disposed therewithin, and comprised also of a pair of interrupted flanges 117 disposed intermediate the annular recesses 113 and in predetermined spaced apart relationship from one another. The function of the pair of annular recesses 113 is to operatively accommodate a pair of drive springs 119, which are shown in broken lines in FIG. 3. The drive springs 119 are disposed in the annular recesses 113 when a hereinafter described drive collar generally designated at 121 is assembled around the hub portion 23, corresponding terminal ends of the springs 119 being abuttably disposed against the right side surfaces of the pins 115, and the opposite terminal ends of the springs being abuttably disposed against hereinafter described recess ends formed in the collar 121.

Figure 10:
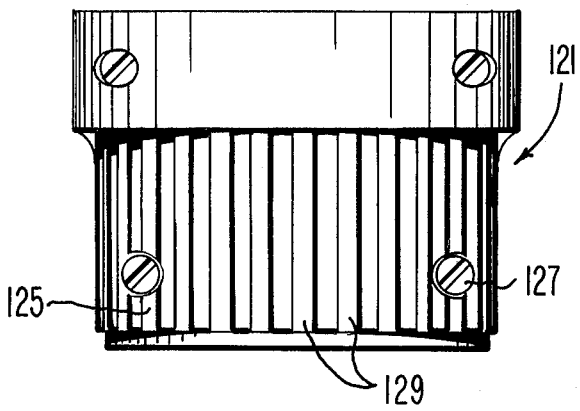
FIG. 10 is an elevational view of the drive collar showing the elongated drive teeth disposed along its exterior surface, and showing the means by which the two half collars thereof are securably attached together.
Figure 11:
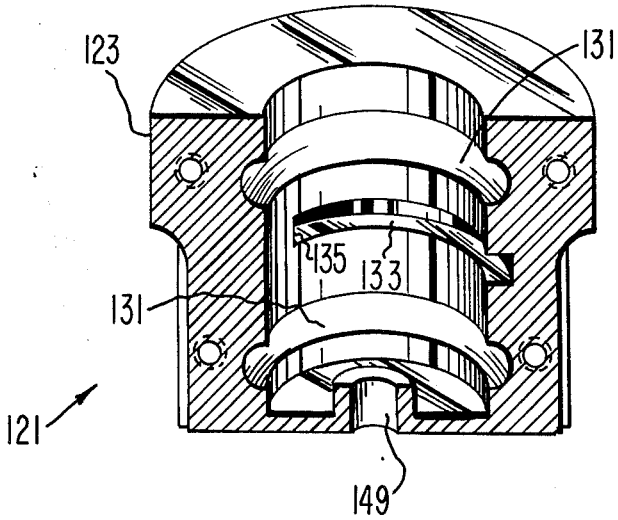
FIG. 11 is an interior view of the rearmost half collar showing the repair of endless annular recesses thereof for accommodating a pair of drive springs, and showing also a central single-ended groove for accommodating the rear-most flange of the hub porton illustrated in FIG. 9.
Figure 12:
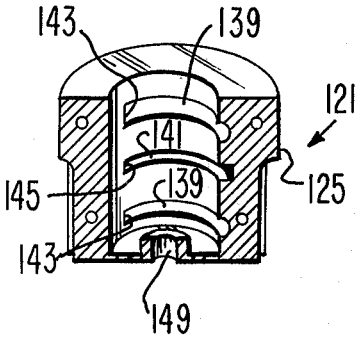
FIG. 12 is an interior view of the frontmost half collar showing a pair of single-ended annular recesses for accommodating the pair of drive springs, and showing also a single-ended central groove for accommodating the frontmost flange of the hub portion.

As shown in FIGS. 10, 11 and 12, the drive collar 121 is comprised of two half collars 123 and 125 that are secured together in encompassing relationship with the hub portion 23 by means of four threaded bolts 127, such bolts passing through apertures formed in the half collar 125 and being securably rceived within threaded apertures formed in the opposite half collar 123. The exterior surface of the half collars 123 and 125 are provided with equally spaced apart drive teeth 129, as best illustrated in FIG. 10. The interior surface of the half collar 123, as illustrated in FIG. 11, is comprised of a pair of open-ended annular recesses 131 for operatively accommodating the drive springs 119, and a single-ended arcuate groove 33 disposed intermediate the annular recesses 131 for operatively accommodating the rearmost flange 117, the single terminal end 135 of the groove 133 cooperating with a terminal end 137 (FIG. 9) of the rearmost flange 117 during the hereinafter described operation of th variable track positioning means. The interior surface of the half collar 125, as illustrated in FIG. 12, is comprised of a pair of single-ended annular recesses 139, for cooperatively accommodating the drive springs 119, and a single-ended arcuate groove 141 for operatively accommodating the frontmost flange 117 shown in FIG. 9. The single terminal ends 143 of the annular recesses 139 serve to abuttably limit the extremities of the drive springs 119 opposite the extremities abuttably disposed against the right side surfaces of the limit pins 115. The single terminal end 145 of the arcuate groove 141 cooperates with a terminal end 147 of the frontmost flange 117 (FIG. 9) during the hereinafter described operation of the variable track positioning means.

Assembly of the half collars 123 and 125 around the hub portion 23, with the drive springs 119 disposed in the annular recesses 113 and in right-side abutting relationship with the limit pins 115, will serve to engage the rearmost flange 117 of the hub with the arcuate groove 133 of the half collar 123, to engage the frontmost flange 117 with the arcuate groove 141 of the half collar 125, and to engage the drive springs 119 with the open-ended annular recesses 131 of the half collar 123 and with the single-ended annular recesses 139 of the half collar 125. With the half collars 123 and 125 so assembled, the terminal ends of the springs 119 opposite the ends disposed in abutting relationship with the limit pins 115 will be abuttably engaged with the single terminal ends 143 of the half collar 125. When in its assembled state as described supra, the drive collar 121 will assume a normal counterclockwise bias relative to the hub portion 23, as produced by the power applied by the springs 119 against the terminal ends 143 of the annular recessses 139. Each of the half collars 123 and 125 is provided with a central notch 149 formed in its lowermost surface, said notch when the half collars are assembled together serving to provide an attachment aperture through which the drive collar may be securably fastened by means of a threaded bolt or the like to the lowermost extremity of the shaft 109, such shaft extending through the hub portion 23 into coupled relationship with the bi-pedalled wedge member 99, as previously described. With the drive collar 121 assembled on the hub portion 23 and in normal counterclockwise biased relationship therewith, the bi-pedalled wedge member 99, as previously described. With the drive collar 121 assembled on the hub portion 23 and in normal counterclockwise biased relationship therewith, the drive collar 121 is permitted a 25° yieldable clockwise rotation relative to the hub portion 23, at the end of which clockwise rotation the terminal end 135 of the arcuate groove 133 of the half collar 123 will limit against the terminal end 137 of the rearmost flange 117 of the hub portion, and the terminal end 145 of the arcuate groove 141 of the half collar 125 will limit against the terminal end 147 of the frontmost flange 117. It can thus be seen that the counterclockwise rotation of the drive drum 7 and hub portion 23, with no load applied to the elongated teeth 129 of the collar 121, will result in the instantaneous and spring activated counterclockwise rotation of the drive collar 121, and when a load is placed on the teeth 129, the counterclockwise rotation of the drive collar 121 will lag 25° behind the counterclockwise rotation of the hub 23, to thereby rotate the shaft 109 and the bi-petalled wedge member 99 25° in a clockwise direction relative to the interior surface 21 of the drive drum, such 25° clockwise rotation of the wedge-shaped outboard members 105 serving to lower the low contact surfaces of the track 79 formed by the declining slope track quadrants 81 and 83, such lowering of the low contact surfaces serving to lengthen the intake stroke of the cylinders, as hereinafter described in greater detail.

OPERATION

During the operation of the inventive internal combustion engine, each of the cylinders is activated sequentially through an intake stroke, compression stroke, power stroke and exhaust stroke, the power stroke of each cylinder serving to displace the raised lobe 85 of the track in a counterclockwise direction as viewed in FIG. 2, such displacement being accomplished by the downward thrust of the connecting rod 31 and the forceable impact of the central roller 35 therof against the declining slope track quadrant 81 upstream of the lobe 85. The ensuring exhaust stroke of each cylinder is effected by the upward camming action of the upstream track quadrant 83 against the central roller 35 of the connecting rod 31, such exhaust stroke terminating when the opposite raised lobe 87 passes under the roller 35. The intake stroke of each cylinder is effected by the downward pulling force of the declining slope track quadrant 81 upstream of the raised lobe 87, such pulling force being achieved through the cooperation of the inwardly directly lips 91 of the track quadrant and the outboard rollers 37 of the connecting rod, as best illustrated in FIG. 6. The compression stroke of each cylinder is effected by the upward camming action of the adjoining upstream track quadrant 83 against the central roller 35 of the connecting rod, such compression stroke terminating when the raised lobe 85 (the power lobe) passes under the roller 35, to thereby initiate a subsequent power stroke of the cylinder.

During the occurrence of the above described strokes of a given cylinder, the intake-exhaust slide 53 thereof is correspondingly activated by the cam ring 69 fixed to the inner circumference of the drum 7. The activation of an intake-exhaust slide 53 of a given cylinder can best be described with reference to FIG. 1, wherein the raised power lobe 85 is represented to be in coincidence with the cylinder disposed in the nine o'clock position. With the drive drum 7 positioned as represented in FIG. 1, and considering the effect of the counterclockwise rotation of the drum relative to the cylinder disposed in the nine o'clock position, it is to be noted that an intermediate depth area 73 of the cam ring 69 is effective to activate the intake-exhaust slide 53 of the cylinder to its intermediate position during the power stroke of the cylinder, that an upstream minimum depth area 75 of the cam ring 69 is effective to activate the intake-exhaust slide 53 to its fully extended position during the exhaust stroke of the cylinder, that an upstream maximum depth area 71 of the cam ring 69 is effective to activate the intake-exhaust slide 53 to its fully retracted position during the intake stroke, and that an upstream intermediate depth area 73 of the cam ring 69 is effective to activate the intake-exhaust slide 53 to its intermediate position during the compression stroke of the cylinder. It can also be seen from FIG. 1 that the firing order of the cylinders is sequential in nature and in counterclockwise order as depicted in FIG. 1, the nine o'clock cylinder being depicted at the beginning of its power stroke, the six o'clock cylinder being depicted at the beginning of its compression stroke, the three o'clock cylinder being depicted at the beginning of its intake stroke, and the 12 o'clock cylinder being depicted at the beginning of its exhaust stroke.

During the above described strokes of the cylinders, the oppositely disposed low contact surfaces of the movable track 79 will be disposed in a normal relatively raised position when a torque load is not applied to the elongated teeth of the drive collar 121, to thereby reduce the length of the intake strokes of the cylinders, and disposed in a relatively lowered position when a torque load is applied to the drive collar 121, to thereby lengthen the intake strokes of the cylinders. As previously indicated, the relatively high positioning of the low contact surfaces of the track 79 is accomplished by the normal counterclockwise bias of the drive collar 121 relative to the hub portion 23, as effectuated by the normal bias of the drive springs 119 against the terminal ends 143 of the annular recesses 139 shown in FIG. 12. As also previously indicated, the relatively low positioning of the low contact surfaces of the track is established by the 25° lag of the drive collar 121 relative to the hub portion 23 when a torque load is placed on the collar, such lag serving to rotate the shaft 109 and the bi-petalled wedge member 99 25° in a clockwise direction relative to the interior webbed surface 21 of the drum, to thereby activate the dovetailed slides 95 to their full intake stroke positions.

Although the inventive internal combustion engine has been described in considerable detail, it will be appreciated that various changes therein may be made by those skilled in the art without departing from the true spirit and scope of the invention.

What is claimed is:

1. A variable stroke internal combustion engine comprising:

a. a rotatably mounted drive drum having a hollow exterior hub portion defining the axis of rotation of said drum and having also an interior webbed surface traversing said axis, b. an apertured stationarily supported mounting plate parallelly disposed of said interior webbed surface and relative to which said drum is free to rotate, c. a plurality of cylinders mounted on said plate in communicating relationship with the apertures thereof, said cylinders being radially arranged in equal spaced apart relationship and in parallel relationship with said exterior hub portion, each of said cylinders being provided with an intake port and an exhaust port and with a slide effective for opening and closing said ports, d. a plurality of pistons operatively housed within said cylinders and a like plurality of connecting rods depending therefrom, each of said connecting rods being disposed for linear movement in the direction of said interior webbed surface of said drum and for reciprocable operation within said corresponding ones of said apertures of said plate, e. movable track means formed of two pairs of interconnected declining slope track quadrants that alternately present a pair of oppositely disposed high contact surfaces and a pair of oppositely disposed low contact surfaces to each of said connecting rods, each pair of declining slope track quadrants being pivotally anchored to said interior webbed surface of said drive drum at the apex of a corresponding high contact surface, the free ends of said declining slope track quadrants defining said oppositely disposed low contact surfaces being movable a predetermined distance toward and away from said interior webbed surface, f. torque responsive variable positioning means associated with said hollow exterior hub portion and with said interior webbed surface and effective for variably positioning said pair of low contact surfaces of said movable track means, said means being effective in response to the presence of a torque load on said exterior hub portion to position said low contact surfaces at a first relatively short distance from said interior webbed surface, and effective in response to the absence of a torque load to position said low contact surfaces at a second relatively greater distance from said webbed surface, g. piston activating means associated with said movable track means and with each of said connecting rods effective for applying a displacing force against one of said high contact surfaces during the power stroke of each cylinder, for pushably applying a retracting force against the connecting rod of a cylinder during the compression and exhaust strokes thereof, and for pullably applying an extending force to the connecting rod of a cylinder during the intake strokes thereof, and h. slide activating means associated with the inner circumference of said drive drum and effective for opening and closing the intake and exhaust ports of said cylinders, said intake port of each cylinder being thereby opened during the intake stroke thereof and closed during the compression, power and exhaust strokes, and said exhaust port of each cylinder being thereby closed during the intake, compression and power strokes thereof and opened during the exhaust stroke.

2. The variable stroke internal combustion engine defined in claim 1 wherein said cylinders are of a double-walled construction and the intake port for each of the cylinders is communicatably coupled by means of said double-walled construction to a fuel-air inlet aperture formed in the outermost wall of the cylinder adjacent said mounting plate, a partition of spiraling configuration disposed between the double walls of each cylinder serving to direct said fuel-air mixture around the innermost wall of the cylinder from said inlet aperture to and through said intake port during the intake stroke of said cylinder to thereby afford a cooling effect on said cylinder and a vaporizing effect on said fuel-air mixture passing therearound.

3. The variable stroke internal combustion engine defined in claim 2 wherein each of said slides effective for opening and closing said intake port and said exhaust port of the cylinder comprises:

a. a body portion mounted for translatory movement along a radius of said drive drum, b. a vertically disposed transecting aperture formed in said body portion and effective for communicatably coupling the exhaust port of said cylinder with extraneous exhaust transmitting and dispelling means, c. a U-shaped channel formed in said body portion and connecting a pair of spaced apart apertures formed in the bottom surface thereof, said pair of apertures during the intake stroke of said cylinder being effective for receiving said fuel-air mixture and for directing said mixture through said intake port into said cylinder, and d. roller means disposed on the outboard extremity of said body portion and in cooperable relationship with said slide activating means of said drive drum.

4. The variable stroke internal combustion engine defined in claim 3 wherein said slide activating means of said drive drum is a cam ring of varying depth fixed to the inner circumference of said drive drum, said cam ring being provided with continuous inwardly directed opposing lips defining a continuous circular channel effective for receiving and operatively activating said roller means of each of said slides, and wherein said roller means includes a bifurcated portion integrally formed with said body portion, a roller carried by the bifurcated portion, and an elongated mounting pin extending through said roller and through apertures formed in said bifurcated portion into cooperable relationship with said inwardly directed opposing lips, each of said slides by reason of said roller and said elongated mounting pin being activated to a fully retracted position within its associated cylinder by a section of said cam ring of maximum depth, to an intermediate position relative to its associated cylinder by a section of said cam ring of intermediate depth, and to a fully extended position relative to its associated cylinder by a section of said cam ring of minimum depth, said fully retracted position effectively opening said intake port of the cylinder and closing said exhaust port, said intermediate position effectively closing said intake port and said exhaust port, and said fully extended position effectively closing said intake port and opening said exhaust port.

5. The variable stroke internal combustion engine defined in claim 1 wherein said piston activating means comprises:

a. a pair of side walls defining the width of said high and said low contact surfaces of said movable track means, and a pair of continuous inwardly directed lips integrally formed with said side walls, and b. a plurality of rollers carried by each of said connecting rods, a central depending roller thereof being disposed in cooperable relationship with said high and said low contact surfaces of said movable track means, and a pair of outboard rollers thereof being disposed in cooperable relationship with continuous inwardly directed lips, whereby a pushable cooperation occurs between said central depending roller and said contact surfaces of said movable track means during the compression, power and exhaust strokes of each cylinder, and a pullable cooperation occurs between said outboard rollers and said continuous inwardly directed lips during the intake stroke of each cylinder.

6. The variable stroke internal combustion engine defined in claim 1 wherein said variable positioning means comprises:

a. an externally toothed collar resiliently coupled exteriorly of said hollow exterior hub portion and for yieldable rotation a predetermined distance relative thereto, b. an actuating shaft fixed to said collar and extending through said exterior hub portion and into transecting relationship with said interior webbed surface of said drive drum, and c. a bi-petalled rotatable wedge member fixed to said actuating shaft and disposed in rotatable relationship with said interior webbed surface of said drive drum, and in slidable supporting relationship with said pair of low contact surfaces of said movable track means, said wedge member being effective for lowering said low contact surfaces a predetermined distance upon the application of a torque load on said collar and for elevating said low contact surfaces a predetermined distance upon the removal of a said torque load from said collar, said predetermined lowering distance serving to maximize the length of the intake strokes of the cylinders and said predetermined elevating distance serving to minimize the length of the intake strokes of the cylinders.

7. The variable stroke internal combustion engine defined in claim 6 wherein said hollow exterior hub portion of said drive drum is provided with an intermediately disposed interrupted flange and a pair of continuous annular recesses disposed in straddling relationship relative to said flange, said annular recessed being provided with a pair of coplanarly arranged limit pins.

8. The variable stroke internal combustion engine defined in claim 7 wherein said externally toothed collar of said variable positioning means is interiorly provided with an interrupted arcuate groove for receiving said interrupted flange of said exterior hub portion, and with a pair of single-ended annular recesses of equal spaced apart distance to the distance between said continous annular recesses of said exterior hub portion, the engageable cooperation of said interrupted flange of said hub portion and said interrupted groove of said collar, by reason of the predetermined linear dimensioning of said flange and said groove, permitting a predetermined limited rotation of said collar relative to said hub portion.

9. The variable stroke internal combustion engine defined in claim 8 wherein said resilient coupling of said externally toothed collar and said exterior hub portion of said drive drum is effectuated by means of a pair of drive springs arranged within said annular recesses of said hub portion and said collar, corresponding first ends of said springs being disposed in right-side abutting relationship with said limit pins in said continuous annular recesses of said hub portion, and corresponding second ends of said springs being disposed in abutting relationship with the single terminal ends of said single-ended annular recesses of said collar, whereby said collar is provided with a normal counterclockwise bias relative to said hub portion and is permitted a predetermined yieldable angular lag in a relative clockwise direction upon the application of a load on said collar.

10. In a four cycle internal combustion engine having a rotatable drive drum including a hollow exterior hub and a plurality of cylinders stationarily mounted in radial arrangement within the inner circumference of said drive drum, each of said cylinders being provided with a piston, a connecting rod coupled to said piston, a compression chamber defined by said piston in conjunction with the walls of said cylinder, a spark plug communicating with said compression chamber and an intake port and exhaust port leading thereinto, and a slide effective for opening and closing said intake port and said exhaust port, the improvement comprising:

a. movable track means securably supported adjacent an interior webbed surface of said drive drum in transverse relationship with the axis of rotation thereof, said movable track means being formed of two pairs of interconnected declining slope track quadrants that alternately present a pair of oppositely disposed high contact surfaces and a pair of oppositely disposed low contact surfaces to each of said connecting rods, each pair of declining slope track quandrants being pivotally anchored to said interior webbed surface at the apex of a corresponding high contact surface, the free ends of said declining slope track quadrants defining said oppositely disposed low contact surfaces being movable a predetermined distance toward and away from said interior webbed surface, b. torque responsive means associated with said hollow exterior hub and with said interior webbed surface and effective for variably positioning said pair of low contact surfaces of said movable track means, said means being effective in response to the presence of a torque load on said exterior hub to position said low contact surfaces at a first relatively short distance from said interior webbed surface, and effective in response to the absence of a torque load on said exterior hub to position said low contact surfaces at a second relatively greater distance from said interior webbed surface, c. means associated with said movable track means and with each of said connecting rods effective for applying a displacing force against one of said high contact surfaces during the power stroke of an associated cylinder, for pushably applying a retracting force against a said connecting rod during the compression and exhaust strokes of an associated cylinder, and for pullably applying an extending force to a said connecting rod during the intake stroke of an associated cylinder, and d. means associated with the interior circumference of said drive drum effective for activating said slides of said cylinders to thereby open and close said intake and exhaust ports thereof, said intake port of each cylinder being thereby opened during the intake stroke thereof and closed during the compression, power, and exhaust strokes, and said exhaust port of each cylinder being thereby closed during the intake, compression and power strokes thereof and opened during the exhaust stroke.

11. The improvement in a four cycle internal combustion engine defined in claim 10 wherein said means for activating said slides of said cylinders comprises:

a. roller means disposed on the outboard extremity of each of said slides and including an elongated mounting pin, and b. a cam ring of varying depth fixed to the inner circumference of said drive drum, said cam ring being provided with continuous inwardly directed opposing lips defining a continuous circular channel effective for receiving and operatively activating said roller means of each of said slides, whereby each of said slides may be activated to a fully retracted position within its associated cylinder by a section of said cam ring of maximum depth, to an intermediate position relative to its associated cylinder by a section of said cam ring of intermediate depth, and to a fully extended position relative to its associated cylinder by a section of said cam ring of minimum depth, said fully retracted position effectively opening said intake port of the cylinder and closing said exhaust port thereof, said intermediate position effectively closing said intake port and said exhaust port, and said fully extended position effectively closing said intake port and opening said exhaust port.

12. The improvement in an internal combustion engine defined in claim 10 wherein said force applying means comprises:

a. a pair of side walls defining the width of said high and said low contact surfaces of said movable track means, and a pair of continuous inwardly directed lips integrally formed with said side walls, and b. a plurality of rollers carried by each of said connecting rods, a central depending roller thereof being disposed in cooperable relationship with said high and said low contact surfaces of said movable track means, and a pair of outboard rollers thereof being disposed in cooperable relationship with said continuous inwardly directed lips, whereby a pushable cooperation occurs between said central depending roller and said contact surfaces of said movable track means during the compression, power and exhaust strokes of each cylinder, and a pullable cooperation occurs between said outboard rollers and said continuous inwardly directed lips during the intake stroke of each cylinder.

13. The improvement in an internal combustion engine defined in claim 10 wherein said torque responsive variable positioning means comprises:

a. an externally toothed collar resiliently coupled exteriorly of said hollow exterior hub and for yieldable rotation a predetermined distance relative thereto, b. an actuating shaft fixed to said collar and extending through said exterior hub and into transecting relationship with said interior webbed surface of said drive drum, and c. a bi-petalled rotatable wedge member fixed to said actuating shaft and disposed in rotatable relationship with said interior webbed surface of said drive drum, and in slideable supporting relationship with said pair of low contact surfaces of said movable track means, said wedge member being effective for lowering said low contact surface a predetermined distance upon the application of a torque load on said collar and for elevating said low contact surfaces a predetermined distance upon the removal of a said torque load from said collar, said predetermined lowering distance serving to maximize the length of the intake strokes of the cylinders and said predetermined elevating distance serving to minimize the length of the intake strokes of the cylinders.

14. The improvement in an internal combustion engine defined in claim 13 wherein said hollow exterior hub of said drive drum is provided with an intermediately disposed interrupted flange and a pair of continuous annular recesses disposed in straddling relationship relative to said flange, said annular recessed being provided with a pair of coplanarly arranged limit pins.

15. The improvement in an internal combustion engine defined in claim 14 wherein said externally toothed collar of said torque responsive variable positioning means is interiorly provided with an interrupted arcuate groove for receiving said interrupted flange of said exterior hub, and with a pair of single-ended annular recesses of equal space apart distance to the distance between said continuous annular recesses of said exterior hub, the engageable cooperation of said interrupted flange of said hub and said interrupted groove of said collar, by reason of the predetermined linear dimensioning of said flange and said groove, permitting a predetermined limited rotation of said collar relative to said hub.

16. The improvement in an internal combustion engine defined in claim 15 wherein said resilient coupling of said externally toothed collar and said exterior hub of said drive drum is effectuated by means of a pair of drive springs arranged within said annular recesses of said hub and said collar, corresponding first ends of said springs being disposed in right-side abutting relationship with said limit pins in said continuous annular recesses of said hub, and corresponding second ends of said springs being disposed in abutting relationship with the single terminal ends of said single-ended annular recesses of said collar, whereby said collar is provided with a normal counterclockwise bias relative to said hub and is permitted a predetermined yieldable angular lag in a relative clockwise direction upon the application of a load on said collar.

17. Improved means for use in a circularly configured stationarily mounted four cycle intermal combustion engine whereby the length of the intake strokes of the cylinders is automatically varied according to the torque load that is applied to the output drive thereof, said length of the intake strokes being maximized upon the application of a torque load to said output drive and minimized upon the absence of any such torque load, said improved means comprising:

a. a rotatably mounted drive drum encircling the cylinders, pistons and connecting rods of said engine and having a hollow exterior hub disposed in parallel relationship therewith, said exterior hub defining the axis of rotation of said drive drum, b. movable track means securably supported adjacent an interior webbed surface of said drive drum in transverse relationship with the axis of rotation thereof, said movable track means being formed of two pairs of interconnected declining slope track quadrants that alternately present a pair of oppositely disposed high contact surfaces and a pair of oppositely disposed low contact surfaces to each of said connecting rods, each pair of declining slope track quadrants being pivotally anchored to said interior webbed surface of the drive drum at the apex of a corresponding high contact surface, the free ends of said declining slope track quadrants defining said oppositely disposed low contact surfaces being movable a predetermined distance toward and away from said interior webbed surface, c. torque responsive means associated with said hollow exterior hub and with said interior webbed surface and effective for variably positioning said pair of low contact surfaces of said movable track means, said means being effective in response to the presence of a torque load on said exterior hub to position said low contact surfaces at a first relatively short distance from said interior of webbed surface, and effective in response to the absence of a torque load on said exterior hub to position said low contact surfaces at a second relatively greater distance from said webbed surface, and d. means associated with said movable track means and with each of said connecting rods effective for applying a displacing force against one of said high contact surfaces during the power stroke of an associated cylinder, for pushably applying a retracting force against a said connecting rod during the compression and exhaust strokes of an associated cylinder, and for pullably applying an extending force to said connecting rod during the intake stroke of an associated cylinder.

18. The improved means defined in claim 17 wherein said force applying means comprises:

a. a pair of side walls defining the width of said high and said low contact surfaces of said movable track means, and a pair of continuous inwardly directed lips integrally formed with said side walls, and b. a plurality of rollers carried by each of said connecting rods, a central depending roller thereof being disposed in cooperable relationship with said high and said low contact surfaces of said movable track means, and a pair of outboard rollers thereof being disposed in cooperable relationship with said continuous inwardly directed lips, whereby a pushable cooperation occurs between said central depending roller and said contact surfaces of said movable track means during the compression, power and exhaust strokes of each cylinder, and a pullable cooperation occurs between said outboard rollers and said continuous inwardly directed lips during the intake stroke of each cylinder.

19. The improved means defined in claim 17 wherein said torque responsive means for variably positioning said pair of low contact surfaces comprises:

a. an externally toothed collar resiliently coupled exteriorly of said hollow exterior hub and for yieldable rotation a predetermined distance relative thereto, b. an actuating shaft fixed to said collar and extending through said exterior hub and into transecting relationship with said interior webbed surface of said drive drum, and c. a bi-petalled rotatable wedge member fixed to said actuating shaft and disposed in rotatable relationship with said interior webbed surface of said drive drum, and in slideable supporting relationship with said pair of low contact surfaces of said movable track means, said wedge member being effective for lowering said contact surfaces a predetermined distance upon the application of a torque load on said collar and for elevating said low contact surfaces a predetermined distance upon removal of said torque load from said collar, said predetermined lowering distance serving to maximize the length of the intake strokes of the cylinders and said predetermined elevating distance serving to minimize the length of the intake strokes of the cylinders.

20. The improved means defined in claim 19 wherein said hollow exterior hub of said drive drum is provided with an intermediately disposed interrupted flange and a pair of continuous annular recesses disposed in straddling relationship relative to said flange, said annular recesses being provided with a pair of coplanary arranged limit pins.

21. The improved means defined in claim 20 wherein said externally toothed collar of said variable positioning means is interiorly provided with an interrupted arcuate groove for receiving said interrupted flange of said exterior hub, and with a pair of single-ended annular recesses of equal spaced apart distance to the distance between said continuous annular recesses of said exterior hub, the engageable cooperation of said interrupted flange of said hub and said interrupted groove of said collar, by reason of the predetermined linear dimensioning of said flange and said groove, permitting a predetermined limited rotation of said collar relative to said hub.

22. The improved means defined in claim 21 wherein said resilient coupling of said externally toothed collar and said exterior hub of said drive drum is effectuated by means of a pair of drive springs arranged within said annular recess of said hub and said collar, corresponding first ends of said springs being disposed in right-side abutting relationship with said limit pins in said continuous annular recesses of said hub, and corresponding second ends of said springs being disposed in abutting relationship with the single terminal ends of said single-ended annular recesses of said collar, whereby said collar is provided with a normal counterclockwise bias relative to said hub and is permitted a predetermined yieldable angular lag in a relative clockwise direction upon the application of a load on said collar.

* * * * *